US006032953A

United States Patent [19]

Otto et al.

[11] Patent Number: 6,032,953

[45] Date of Patent: Mar. 7, 2000

[54] SMUDGE-FREE SHEET MATERIAL HANDLING APPARATUS AND METHOD

[75] Inventors: Edward M. Otto, Bethlehem; James N. Driscoll, Perkasie, both of Pa.

[73] Assignee: Bell & Howell Mail and Messaging Technologies Company, Durham, N.C.

[21] Appl. No.: 09/097,945

[22] Filed: Jun. 16, 1998

[51] Int. Cl.[7] ..... B65H 29/00

[52] U.S. Cl. ..... 271/303; 271/176; 271/220; 414/790.3

[58] Field of Search ..... 271/245, 267, 271/303, 176, 84, 220, 223, 224; 414/790.3

[56] References Cited

U.S. PATENT DOCUMENTS 3,659,728 5/1972 Reinecke ..... 414/790.3

5,251,892 10/1993 No et al. ..... 271/84 X

FOREIGN PATENT DOCUMENTS 2028285 3/1980 United Kingdom ..... 414/790.3

*Primary Examiner*—David H. Bollinger

*Attorney, Agent, or Firm*—Jenkins & Wilson, P.A.

[57] ABSTRACT

A smudge-free sheet material handling apparatus and method are disclosed. The device moves sheet material by only pushing on the edges of the sheet material. Since there is no toner or ink at these locations, the sheet material can be fed without risk of smudging the toner material on the sheet surfaces. Furthermore, since no high friction parts come into relative contact/movement with the surfaces of the sheet material, smudging is even further reduced.

31 Claims, 4 Drawing Sheets

SMUDGE-FREE SHEET MATERIAL HANDLING APPARATUS AND METHOD

TECHNICAL FIELD

This invention is generally directed to the field of sheet material handling. In particular, the invention is directed to an apparatus and method for handling sheet material to a downstream location in which a minimum of moving or high friction parts come into contact with or move relative to the sheet material.

BACKGROUND OF THE INVENTION

In the field of sheet material handling, it is important to not damage sheet material as it is being handled. Besides obvious sheet material damaging, such as dog-ears, curls, or the like, a serious, but less obvious problem concerns toner smearing. Typically, sheet material will be fed a short time after it has been printed on and therefore the toner will not be completely set on the sheet material and may smudge if contacted. Smudging can even occur on set toner. Furthermore, in sheet material collecting or accumulating applications, after the sheet material is collected or accumulated into a stack, in the prior art, the sheet material stack has been fed out of the collector/accumulator area by either a lugged belt or clamping the upper and lower surfaces of the sheet material stack between a non-lugged belt and an idler roller or belt.

A problem faced by these prior art solutions concerns the fact that the sheet material contacting surfaces of belts and rollers, which are typically made of rubber, must have a high coefficient of friction so that they can grip and move the sheet material stack. Accordingly, as the belts and rollers accelerate, de-accelerate, or merely come into any type of relative movement with the sheet material, the tendency will be to smear toner. As will be appreciated by those of skill in the art, this smearing is unacceptable.

Accordingly, there is room for improvement within the art of sheet material handling and collecting.

OBJECTS OF THE INVENTION

It is an object of the invention to provide a sheet material handling apparatus and method in which sheet material damage due to toner smearing is minimized.

It is a further object of the invention to provide a sheet material handling apparatus and method in which sheet material damage due to toner smearing is minimized due to the sheet material coming into contact and/or relative movement with a minimum number of high friction components.

It is a further object of the invention to provide a sheet material handling apparatus and method in which sheet damage due to toner smearing is minimized and can be used as a sheet material collector or accumulator or sheet material stacker.

It is a further object of the invention to provide a sheet material handling apparatus and method in which sheet material damage due to toner smearing is minimized and can be used as a sheet material diverter.

It is a further object of the invention to provide a sheet material handling apparatus and method in which sheet material damage due to toner smearing is minimized and can be used with sheet material of different sizes.

These and other objects of the invention are achieved by use of a method of handling sheet material, comprising: feeding a sheet having a leading edge and a trailing edge from a first location to a second location; properly positioning the leading edge of the sheet; providing the sheet with a way to exit the second location; and causing the sheet to exit the second location by pushing the trailing edge of the sheet towards a downstream location.

Additionally, these and other objects of the invention are achieved by a smudge-free sheet material handling apparatus, comprising: an infeed area; a collection area; and a registration area; and wherein the collection area has: (a) a collection plate that is lower than the infeed area and (b) registration members for registering sheet material collecting on the collection plate into a squared stack; and a kicker mechanism, the kicker mechanism pushing the squared stack out of the collection area by contacting the trailing edges of the sheet material forming the stack.

BRIEF DESCRIPTION OF THE DRAWINGS

Figure One is a perspective view of an exemplary embodiment of a apparatus according to the invention and in the form of a sheet material kicker collector;

Figure Two is an elevation view of an exemplary embodiment of a sheet material kicker collector according to the invention and showing the infeed of sheet material;

Figure Three is a plan view of an exemplary embodiment of a apparatus according to the invention and in the form of a sheet material kicker collector and having sheet material in the collection area;

Figures Four A–C are plan views depicting the operation of the apparatus according to the invention and in the form of a sheet material kicker collector; and Figure Five is a plan view of an alternative embodiment of a apparatus according to the invention and in the form of a diverter mechanism.

DETAILED DESCRIPTION OF THE DRAWINGS

With reference to the drawings, a sheet material handling apparatus and method that meets and achieves the various objects of the invention set forth above will now be described. In its first form, the sheet material handling apparatus is in the form of sheet material sheet material kicker collector 5. However, it is equally plausible for sheet material sheet material kicker collector 5 to comprise a sheet material kicker accumulator and it should be understood that as discussed herein, "collector" means either sheet material collector or accumulator.

Figure 1:
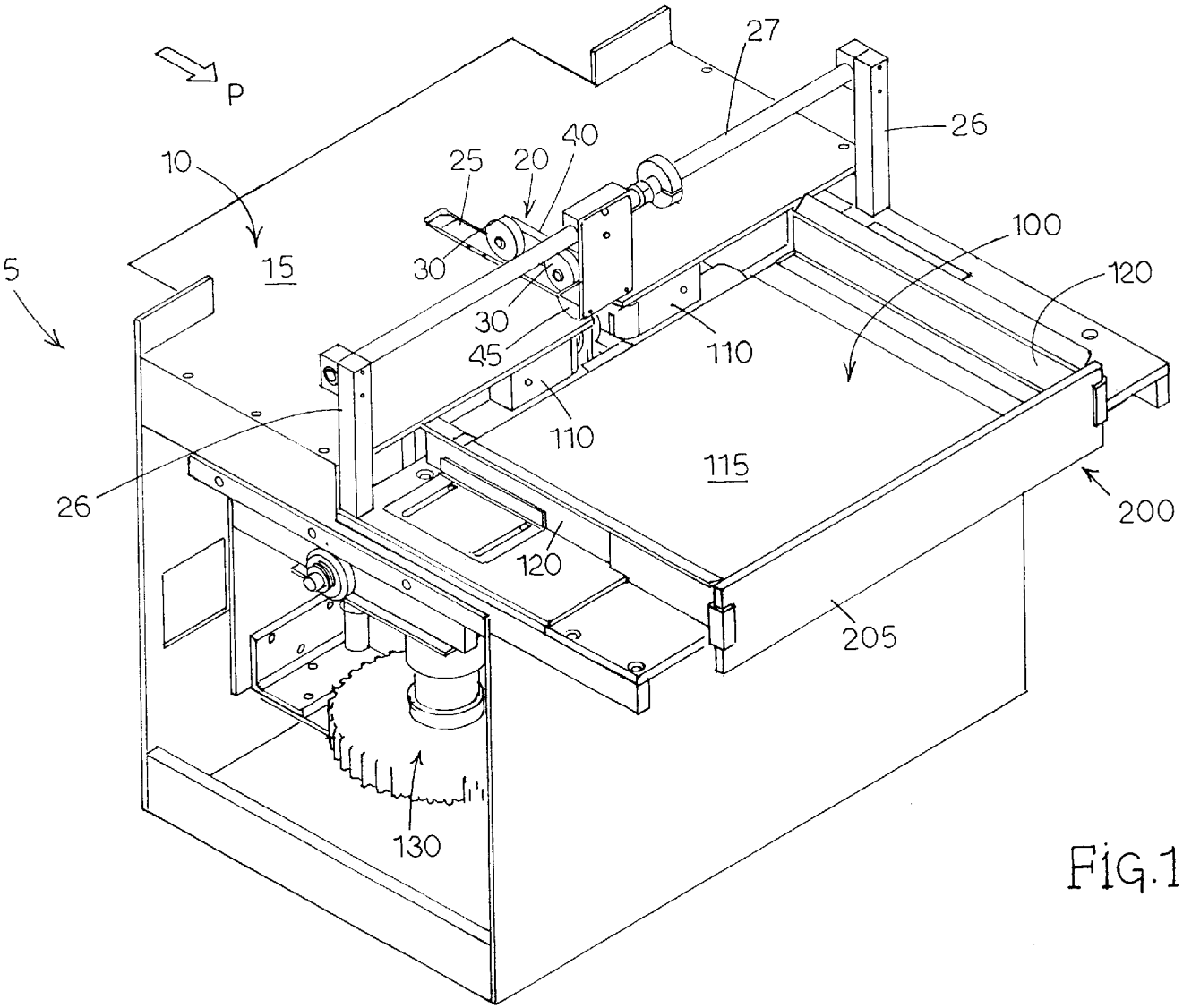

A perspective view of an exemplary embodiment of a sheet material kicker collector apparatus 5 according to the invention is shown in FIG. 1.

Sheet material kicker collector 5 is made up of three general portions or areas, namely: infeed area 10, collector area 100, and registration/front stop area 200. Each one of these three areas will be separately described in detail below.

Sheet material is fed in the direction of arrow P from an upstream location to the collector area 100, via infeed area 10. The upstream location may comprise a printer or other source of printed sheet material. The printed sheet material is fed across infeed plate 15 of infeed area 10 by infeed mechanism 20. Infeed plate 15 will preferably be made of a very low friction material such as TEFLON to reduce the friction between the sheet material and the infeed plate 15. Infeed mechanism 20 can generally comprise any of a number of conventional sheet feeding mechanisms. In the exemplary embodiment shown in FIG. 1, infeed mechanism 20 comes in the form of a lower driven infeed conveyor belt 25 and an overhead pair of infeed idler rollers 30. Infeed conveyor belt 25 is driven by a conventional motor (not shown) located under infeed plate 15. Infeed idler rollers 30 are positioned above infeed conveyor belt 25 and are constantly driven by infeed conveyor belts 25. Infeed idler rollers 30 ride up over the top of sheet material it is driving into collection area 100. Because sheet material is fed continuously through infeed area 10, i.e., there is no stop and start sheet movement, there will be minimal relative movement between the high friction surfaces of infeed conveyor belt 25 and overhead idler rollers 30 and therefore toner smearing is minimized as the sheet material moves through the feed nip. Infeed idler rollers 30 are supported above the infeed conveyor belt 25 by a spring-loaded cantilever arm 40. The cantilever arm 40 is supported by vertical infeed supports 26 and horizontal infeed support 27. Finally, a sheet counter or other sensor 45 can be supported to infeed horizontal support 27 by support 35.

Sheet material or pre-collected sub-sets of sheet material is fed from upstream and stacked one-upon-the-other in collection area 100 to form a stack of sheet material for feeding further downstream as a single unit. Collection area 100 comprises a collection plate 115, also preferably made of a very low friction material such as TEFLON. Collection plate 100 is at a lower elevation that infeed plate 15 so that incoming sheet material S is unobstructed by the stack of sheet material that is forming in the collection area 100 (see FIG. 2). Rising in a direction normal to the collection plate 115 are transversely adjustable side guides 120. Adjustable side guide 120 not only register the forming sheet material stack S' to keep its side edges square but are adjustable so that different sized sheet material can be accommodated in the collection area 100.

In the rear of collection area 100 and located under infeed plate 15 are kicker members in the form of one or more paddles 110. Paddles 110, as will be described in more detail below, are used to push the sheet material stack from the rear and out of collection area 100, as will be described below. Paddles 110 are rotatable and rotated by, for example, a motor/gear drive system 130 and shaft 135 located under infeed area 10.

Figure 2:
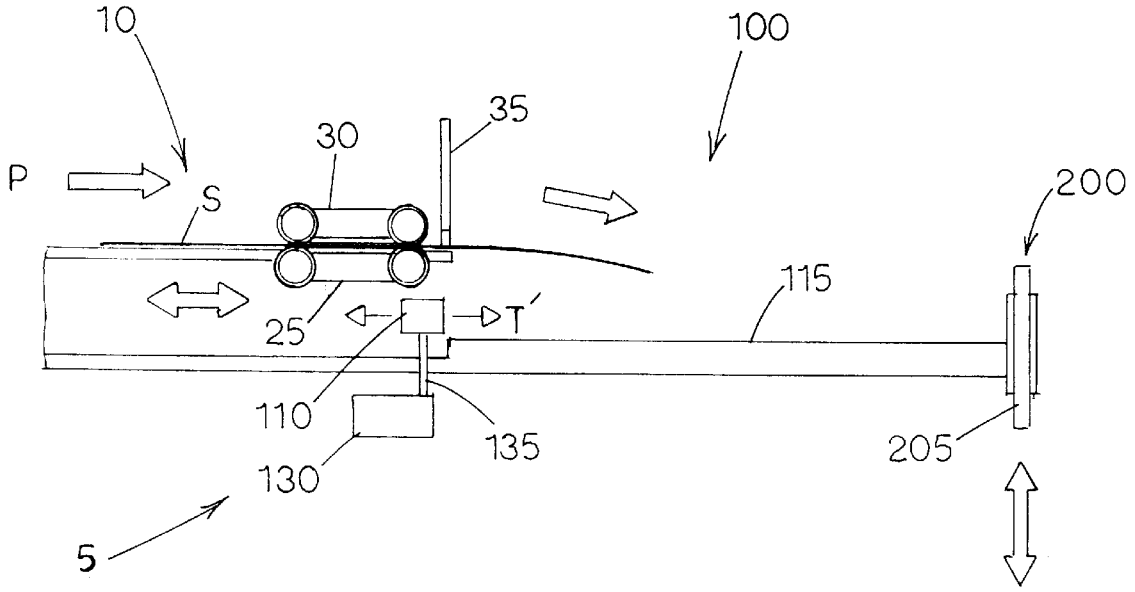
Figure 3:
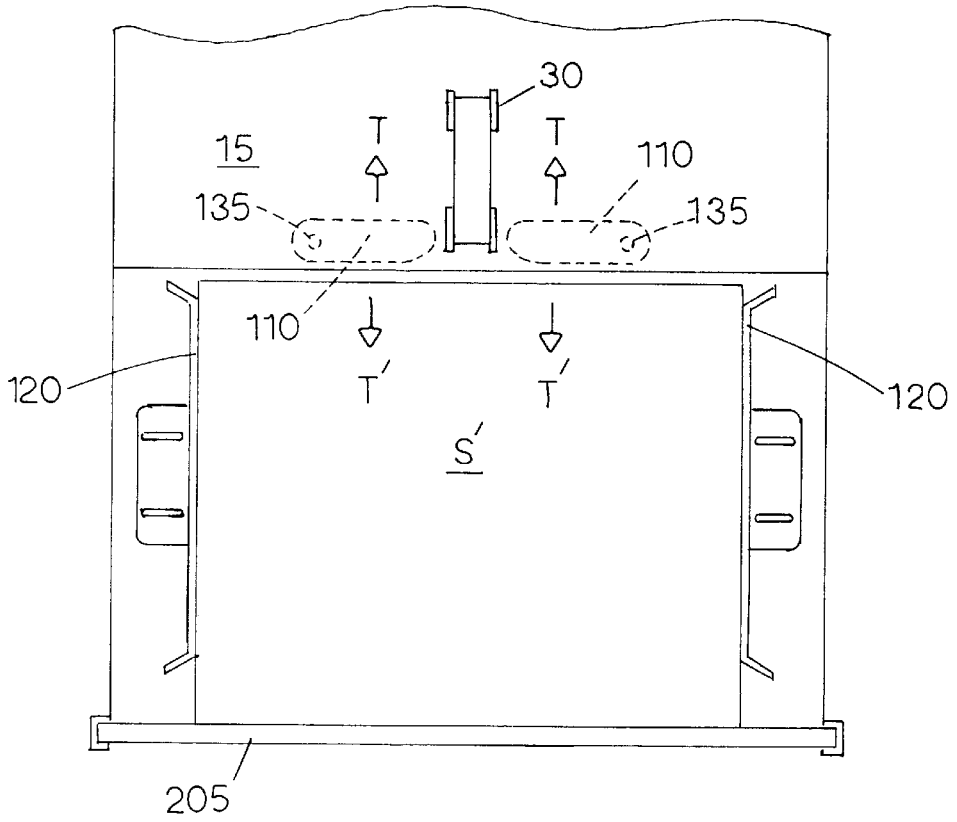

As shown in FIGS. 2 and 3, the position of paddles 110 under infeed area 10 are adjustable. Paddles 110 can telescope in direction T–T' as a single unit adjusting the size of the collection area 100 for various lengths of sheet material. Conventional mechanisms, such as but not limited to a rack and pinion, can be used to allow the telescoping of paddles 110 in direction T–T'.

Located at the very front of apparatus 5 is front stop/registration mechanism 200. Mechanism 200 front registers the sheet material stack forming in collection area 100. The structure of front stop mechanism 200 can take any number of conventional forms and is not critical to meeting the objects of the invention. For purposes of describing the overall operation of sheet material kicker collector 5 only, front stop/registration mechanism 200 is shown in the form of a generic and conventionally vertically movable wall 205. In one position, wall 205 blocks the exit from collection area 100. In its other position, wall 205 is moved out of the exit area from collection area 100 to allow the sheet material stack to be ejected. As shown in FIG. 2, wall 205 can be moved either up or down in this situation. However walls with other modes of movement are equally applicable to the invention.

Having described the structure of sheet material kicker collector 5, its method and mode of operation will now be described with reference to the drawings. In particular, this description will be made with reference to FIGS. 4A–C.

Sheet material S in the form of printed sheet material is fed in direction P from an upstream location towards sheet material kicker collector 5 via conventional technology. The upstream source of printed sheet material may comprise either sheet material coming directly out of a printer or a supply of previously printed sheet material. In either case, the sheet material will have toner thereon which, if comes into contact with the high friction, materials such as rubber, which typical sheet conveying elements are constructed, will be smudged.

As these sheet material is fed into infeed area 10, they are captured between infeed conveyor 25 and overhead idler rollers 30. Infeed conveyor 25 will be constantly operating at a speed very close if not identical with the speed by which the printed sheet material is being fed from the upstream location. Since the printed sheet material will not undergo any change in speed, there should be no relative movement between the sheet surfaces and the high friction surfaces of infeed conveyor 25 and idler rollers 30. Since there will be no relative movement, there should be no toner smudging due to these sheet moving elements. Furthermore, since infeed plate 15 is made from a very low friction material such as TEFLON, it will not smudge the lower sheet surfaces as they are fed across the infeed plate.

As the printed sheet material or pre-collected subsets of sheet material is fed through infeed conveyor 25 and overhead idlers 30, they may be counted by using sheet sensor 45. After a certain number of sheet material or pre-collected subsets of sheet material are detected or counted, a signal can be sent to the machine controller (not shown) to activate the kicker as will be described.

Sheet material or pre-collected subsets of sheet material fed through infeed conveyor 25 and overhead rollers 30 then start to collect on collection plate 115 to form a stack. Again, since collection plate 115, like infeed plate 15, is made from a very low friction material such as TEFLON, it will not smudge the lowermost sheet's surface as it is fed across and onto collection plate 115. As the sheet material stack forms, it is front registered by vertically movable wall 205, which will be in its registration position blocking the front exit to collection area 100. As the sheet material stack forms, it will be side registered by adjustable side guides 120 and rear registered against paddles 110 that telescope in feed direction P, adjusting the size of collection area 100 for various material lengths. The stack formed will therefore be substantially registered along all sheet surfaces.

Figures 4A, 4B, 4C:
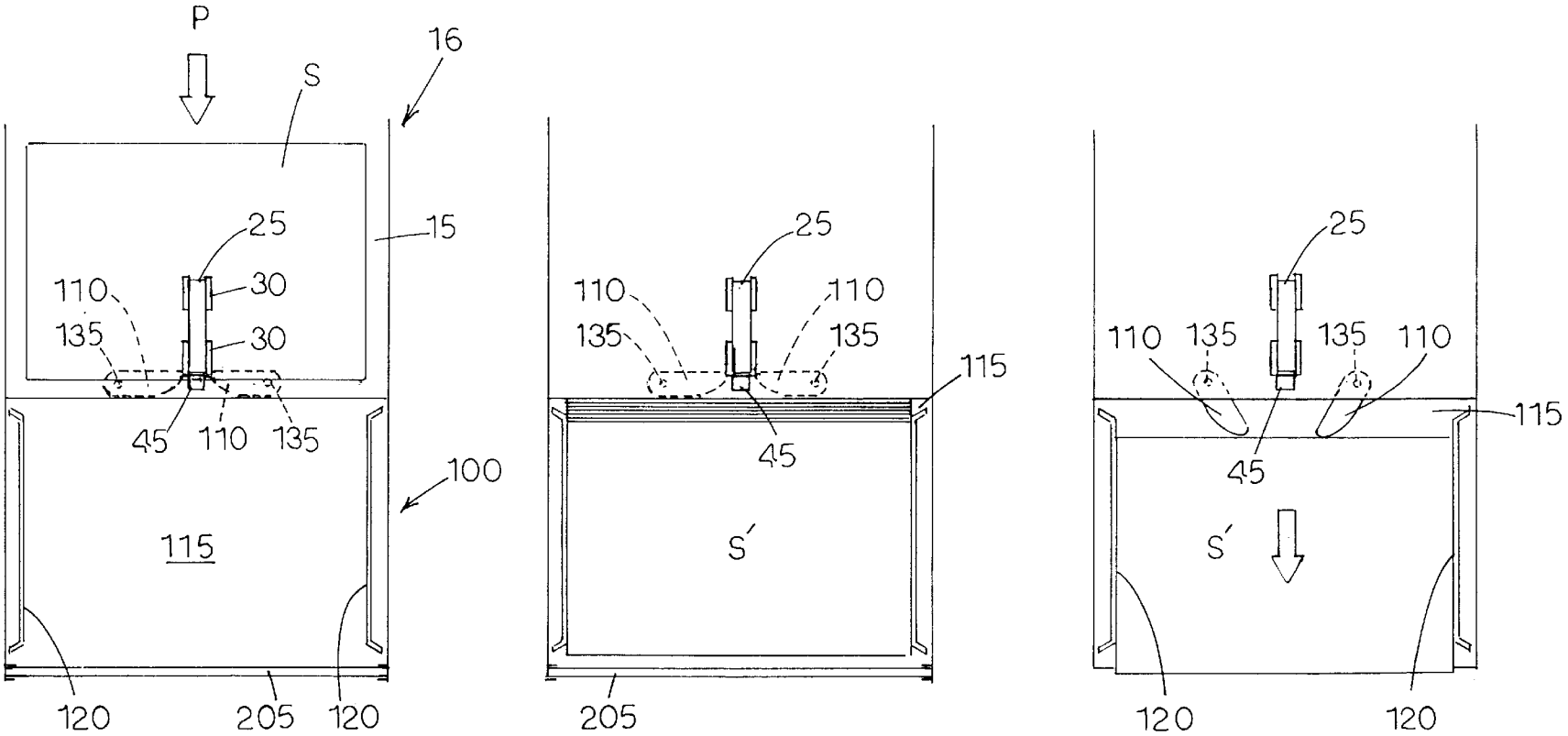

After a predetermined number of sheet material has been collected in the stack forming on the collection plate 115 in collection area 100, a signal to eject the stack will be given. The predetermined number of sheet material can be detected by sensor 45. Upon the determination that a predetermined number of sheet material is within collection area 100, as shown in FIG. 4C, a signal will be given to move vertically movable wall 205 out of the sheet path. A signal will then be sent to kicker motor 130 to initiate rotation of paddles 110. The rotation of paddles 110 is quite fast (maximum speed approximately 80 inches per second). Paddles 110, which will typically be as tall as the sheet material stack formed in collection area 100, then hit the rearmost edge of the sheet material stack and start to push the sheet material stack out of collection area 100. Because paddles 110 are typically as tall as the sheet material stack, the sheet material stack will not become unregistered by the pushing of paddles 110, i.e., all the sheet material will be pushed at the same time.

Paddles 110 then continue with their rotation. The momentum that they provide to the sheet material stack in combination with the slipperiness of collection plate 115 will cause the sheet material stack to be entirely ejected outside of collection area 100 and towards a downstream location. That downstream location can be any of a number of conventional operations, such as feeding the stack into another stack or another transport mechanism, or stuffing the stack into an envelope. Furthermore, because paddles 110 never come into contact with a printed surface of a sheet, as the sheet material is ejected their printed portions are not contacted, thereby reducing smear.

Figure 5:
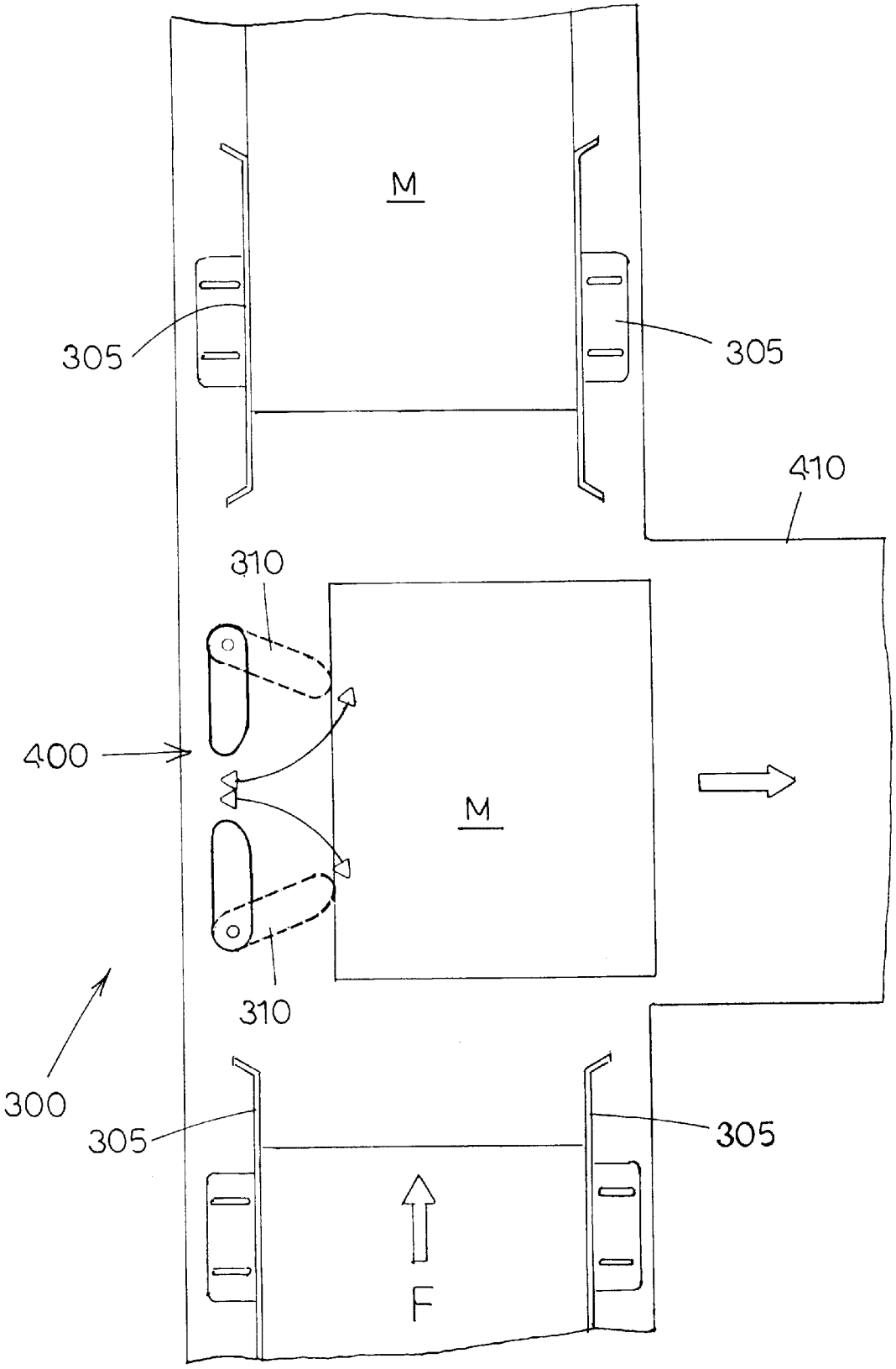

While sheet material kicker collector 5 has been described as useful in the collection/accumulation of printed sheet material into a stack and then ejecting the stack from the collection area, other uses of kickers 110 are possible. For example, as shown in FIG. 5, kickers 310 can be used to eject an insert from an inserter raceway. In particular, as shown in FIG. 5, inserts or other documents M are moving from upstream to downstream in the direction of arrow F. Side guides 305 keep the documents M in proper registration. When a faulty document reaches a divert area 400, a control signal is sent to the motors (not shown) connected to paddles 310. The paddles 310 are then rotated, thereby kicking the faulty document out of sheet path F and in the direction of a divert path 410. Through use of this structure, documents M can be diverted with a minimal chance of being damaged.

The above description is given with reference to a smudge-free sheet material handling apparatus and method. However, it will be understood that various details of the invention may be changed without departing from the scope of the invention. Furthermore, the foregoing description is for purpose of illustration only, and not for purpose of limitation, as the invention is defined by the following, appended claims.

What is claimed is:

1. A method of handling sheet material, comprising:

(a) feeding a sheet having a leading edge and a trailing edge from a first location to a second location;

(b) positioning said leading edge of said sheet against a gate;

(c) providing said sheet with a way to exit said second location by moving said gate out of the way of said leading edge; and (d) causing said sheet to exit said second location by pushing said trailing edge of said sheet towards a downstream location.

2. The method according to claim 1, wherein said movable gate has a planar surface for abutting said leading edge of said sheet.

3. The method according to claim 1, wherein said step of causing said sheet to exit said second location is carried out by the use of at least one rotatable kicker member which contacts said trailing edge of said sheet.

4. The method according to claim 3, further comprising the step of telescoping said at least one rotatable kicker member to allow for the feeding of different sized sheet material.

5. The method according to claim 1 wherein said step of feeding said sheet includes feeding said sheet across a low friction surface disposed at said first location.

6. The method according to claim 1 wherein said step of causing said sheet to exit said second location includes pushing said sheet across a low friction surface disposed at said second location.

7. The method according to claim 1 wherein said sheet is continuously fed from said first location to said second location.

8. The method according to claim 1 further including the step of feeding said sheet to said first location at a first feed speed, wherein said sheet is fed from said first location to said second location at a second feed speed and said second feed speed is substantially equal to said first feed speed.

9. The method according to claim 1 wherein said step of causing said sheet to exit said second location is carried out without making contact with a printed surface of said sheet.

10. A method for feeding sheet material to a downstream location, comprising:

(a) feeding sheet material having a leading edge and a trailing edge from an upstream location to an intermediate location;

(b) collecting a plurality of sheet material at said intermediate location one on top of the other to form a stack;

(c) registering said sheet material against a registration wall as they are collected;

(d) determining when a predetermined number of sheet material has collected at said intermediate location; and (e) discharging said stack from said intermediate location and towards a downstream location by moving said registration wall out of the way of said leading edges of said sheet material and pushing the trailing edges of said sheet material.

11. The method of claim 10, wherein said step of registering said sheet material is carried out by placing said registration wall in a position whereby said leading edges of said sheet material abut against said registration wall.

12. The method according to claim 10, wherein said step of discharging further comprises the step of:

(f) using at least one rotatable kicker member to push the trailing edge of the sheet material stack towards said downstream location.

13. The method according to claim 12, wherein said step of using a rotatable kicker member comprises using a rotatable kicker member that rotates about an axis perpendicular to the surface of said sheet material.

14. The method according to claim 12, wherein said step of discharging further comprises the step of sliding said stack of sheet material across a low friction material.

15. A smudge-free sheet material handling apparatus, comprising:

(a) an infeed area; a collection area; and a registration area; and wherein said collection area has: (i) a collection plate that is lower than said infeed area and (ii) registration members including a movable wall for registering sheet material collecting on said collection plate into a squared stack; and (b) a kicker mechanism, said kicker mechanism pushing the squared stack out of said collection area by contacting the trailing edges of the sheet material forming the stack.

16. The apparatus according to claim 15, wherein said kicker mechanism comprises at least one rotatable kicker member located at least partially under the infeed area.

17. The apparatus according to claim 16, wherein said kicker mechanism telescopes in the sheet feed direction.

18. The apparatus according to claim 15 wherein said infeed area includes a low friction surface.

19. The apparatus according to claim 15 Wherein said collection area includes a low friction surface.

20. The apparatus according to claim 15 wherein said registration area includes a side guide, said side guide being adjustable to accommodate differently sized sheet material in said collection area.

21. The apparatus according to claim 15 further comprising an infeed mechanism for feeding said sheet material from said infeed area to said collection area at substantially the same speed as said sheet material is provided to said infeed area from an location disposed upstream from said infeed area.

22. A smudge-free sheet material handling apparatus, comprising:

(a) an inserter raceway extending in a first direction and for feeding sheet material in a feed direction, the inserter raceway including a side guide for registering said sheet material in the feed direction;

(b) a divert path extending in a second direction, perpendicular to said first direction, from said inserter raceway and for diverting sheet material in a divert direction; and (c) a kicker mechanism rotatable between a diverting position and a non-diverting position, said kicker mechanism positioned on the opposite side of said inserter raceway from said divert path;

whereby said kicker mechanism can divert a sheet from said insert raceway and to said divert path without contacting the surfaces of said sheet material, and said sheet material is permitted to be fed across said insert raceway in said feed direction without engaging said kicker mechanism when in its non-diverting position.

23. The device according to claim 22, wherein said kicker mechanism contacts an edge of said sheet material when said kicker mechanism is diverting said sheet material to said divert path.

24. A method of handling sheet material, comprising:

(a) feeding a sheet having a leading edge and a trailing edge from a first location to a second location;

(b) positioning said leading edge of said sheet;

(c) providing said sheet with a way to exit said second location; and (d) causing said sheet to exit said second location by pushing said trailing edge of said sheet towards a downstream location, wherein said sheet is pushed by contacting said trailing edge of said sheet with a rotatable kicker member.

25. The method according to claim 24, further comprising the step of telescoping said rotatable kicker member to allow for the feeding of different sized sheet material.

26. A method for feeding sheet material to a downstream location, comprising the steps of:

(a) feeding sheet material having a leading edge and a trailing edge from an upstream location to an intermediate location;

(b) collecting a plurality of sheet material at said intermediate location one on top of the other to form a stack;

(c) registering said sheet material as they are collected by placing a registration wall in a position whereby said leading edges of said sheet abut against said registration wall;

(d) determining when a predetermined number of sheet material has collected at said intermediate location; and (e) discharging said stack from said intermediate location and towards a downstream location by pushing the trailing edges of said sheet material and moving said registration wall out of the way of said leading edges of said sheet material.

27. A method for feeding sheet material to a downstream location, comprising:

(a) feeding sheet material having a leading edge and a trailing edge from an upstream location to an intermediate location;

(b) collecting a plurality of sheet material at said intermediate location one on top of the other to form a stack;

(c) registering said sheet material as they are collected;

(d) determining when a predetermined number of sheet material has collected at said intermediate location; and (e) discharging said stack from said intermediate location and towards a downstream location by pushing the trailing edges of said sheet material using a rotatable kicker member.

28. The method according to claim 27, wherein said step of using a rotatable kicker member comprises using a rotatable kicker member that rotates about an axis perpendicular to the surface of said sheet material.

29. The method according to claim 27, wherein said step of discharging further comprises the step of sliding said stack of sheet material across a low friction material.

30. A smudge-free sheet material handling apparatus, comprising:

(a) an infeed area; a collection area; and a registration area; and wherein said collection area has:

(i) a collection plate that is lower than said infeed area; and (ii) registration members for registering sheet material collecting on said collection plate into a squared stack; and (b) a kicker mechanism including a rotatable kicker member located at least partially under the infeed area, said kicker mechanism pushing the squared stack out of said collection area by contacting the trailing edges of the sheet material forming the stack.

31. The apparatus according to claim 30, wherein said kicker mechanism telescopes in the sheet feed direction.

* * * * *